US008652020B2

(12) United States Patent
Davis et al.

(10) Patent No.: US 8,652,020 B2
(45) Date of Patent: Feb. 18, 2014

(54) GUIDE NOZZLE FOR USE WITH FILTER ROD MANUFACTURING APPARATUS

(75) Inventors: Andy Davis, London (GB); William David Lewis, London (GB)

(73) Assignee: British Amercian Tobacco (Investments) Limited, London (GB)

( * ) Notice: Subject to any disclaimer, the term of this patent is extended or adjusted under 35 U.S.C. 154(b) by 65 days.

(21) Appl. No.: 13/259,695

(22) PCT Filed: Feb. 23, 2010

(86) PCT No.: PCT/EP2010/052267

§ 371 (c)(1),
(2), (4) Date: Feb. 6, 2012

(87) PCT Pub. No.: WO2010/108740

PCT Pub. Date: Sep. 30, 2010

(65) Prior Publication Data

US 2012/0122639 A1 May 17, 2012

(30) Foreign Application Priority Data

Mar. 26, 2009 (GB) ..... 0905211.9

(51) Int. Cl.
*B31C 99/00* (2009.01)

(52) U.S. Cl.
USPC ..... 493/39; 493/47; 493/50; 131/274

(58) Field of Classification Search
USPC ..... 493/39, 42, 45, 47, 48, 50; 131/274, 88, 131/84.1, 84.2, 84.3
See application file for complete search history.

(56) References Cited

U.S. PATENT DOCUMENTS

| | | | | |
|---|---|---|---|---|
| 4,281,671 | A | 8/1981 | Bynre | |
| 4,770,193 | A | 9/1988 | Pryor | |
| 4,807,809 | A * | 2/1989 | Pryor et al. | 131/84.1 |
| 5,163,452 | A * | 11/1992 | Marritt et al. | 131/84.1 |
| 5,331,976 | A * | 7/1994 | St. Pierre | 131/96 |

(Continued)

FOREIGN PATENT DOCUMENTS

| | | | |
|---|---|---|---|
| CN | 200997902 | Y | 1/2008 |
| EP | 1741353 | A1 | 1/2007 |

(Continued)

OTHER PUBLICATIONS

International Search Report and Written Opinion, mailed May 26, 2010, for PCT International Application No. PCT/EP2010/052267, filed Feb. 23, 2010.

(Continued)

*Primary Examiner* — Hemant M Desai
(74) *Attorney, Agent, or Firm* — N W Poulsen

(57) ABSTRACT

A guide nozzle (112) for use with an apparatus (110) for the manufacture of filter rods for smoking articles. The guide nozzle comprises a support member (130) configured to be fixed relative to said apparatus for the manufacture of filter rods, a funnel (120) through which loose filter material is propelled, mounted to the support member and, an adjuster (140) mounted between the support member and the funnel to enable the relative position of the funnel and the support member to be adjusted to control the direction of flow of loose filter material propelled through the funnel. An apparatus for the manufacture of filter rods for smoking articles having such a guide nozzle, and a method of manufacturing a filter rod using the same.

24 Claims, 11 Drawing Sheets

(56) References Cited

U.S. PATENT DOCUMENTS

| | | | | |
|---|---|---|---|---|
| 2005/0255978 | A1* | 11/2005 | Lanier et al. | 493/39 |
| 2006/0135335 | A1* | 6/2006 | Dawson et al. | 493/39 |
| 2010/0152008 | A1* | 6/2010 | Lanier et al. | 493/44 |

FOREIGN PATENT DOCUMENTS

| | | | |
|---|---|---|---|
| EP | 1917870 | A2 | 5/2008 |
| EP | 1917871 | A1 | 5/2008 |
| WO | 01/58565 | A2 | 8/2001 |
| WO | 2006/010895 | A1 | 2/2006 |
| WO | 2008016839 | A1 | 2/2008 |

OTHER PUBLICATIONS

International Preliminary Report on Patentability dated Sep. 27, 2011 for International Patent Application PCT/EP2010/052267, filed Feb. 23, 2010.

* cited by examiner

GUIDE NOZZLE FOR USE WITH FILTER ROD MANUFACTURING APPARATUS

CLAIM FOR PRIORITY

This application is a National Stage Entry entitled to and hereby claims priority under 35 U.S.C. §§365 and 371 to corresponding PCT Application No. PCT/EP2010/052267, filed Feb. 23, 2010, which in turn claims priority to British Application Serial No. GB 0905211.9, filed Mar. 26, 2009. The entire contents of the aforementioned applications are herein expressly incorporated by reference.

The present invention relates to a guide nozzle for use with an apparatus for the manufacture of filter rods for use in smoking articles, an apparatus incorporating such a guide nozzle and, a method of manufacture of a filter rod using the same.

Apparatus and machinery are known for the production of filter rods for smoking articles, and generally comprise a tapering duct or 'tongue' through which loose filter tow material is conveyed to compress it into the form of a rod, a guide nozzle to guide the filter tow material into the entrance opening of the tongue, and an air jet or 'stuffer jet' which propels the filter tow material through the nozzle and initially compresses it prior to it entering the tongue. The tongue has an open slot at its underside to accommodate a shaped track and a continuous belt or 'garniture' which runs on the track. The garniture conveys filter wrapping paper on its upper surface which collects the filter tow material and conveys it through the tongue where it is formed into a wrapped filter rod.

It is also known to provide filter rods having a single central thread extending in an axial direction through their length. Apparatuses for the production of such known filter rods can include a hollow tube which extends into the entrance opening of the tongue for feeding the thread through the hollow tube into the tongue as filter tow material is conveyed though the tongue. The thread is entrained in the flow of filter tow material as it travels though the tongue and so the resulting filter rod has the thread extending in a generally axial direction thereof.

A number of problems are associated with the known methods and apparatuses for producing filter rods for smoking articles having a thread therein. For example, they do not reliably allow manufacturers to accurately place the thread inside the filter rods and so the threads are prone to being off-centre, or the position varying along the length of the filter rod. This can result in uneven migration of for example, the flavourant which may be impregnated into the thread, which in some cases can result in spotting or similar spoilage of the casings or coverings or wrappers wrapped around filters etc.

The Applicant is currently developing an improved filter rod producing apparatus to enable production of filter rods with multiple threads accurately located therein. However, the above-mentioned problem with known filter-rod producing apparatuses being unable to position a thread within a filter rod with an acceptable degree of accuracy, is similarly applicable to these latest multiple-thread filter rod producing apparatuses being developed. Although solutions have been developed to accurately locate multiple threads within a filter rod relative to the other threads in the desired configuration, there remains a problem of being able to accurately position the set thread configuration centrally within the filter rod.

Accordingly, the present invention seeks to substantially alleviate or overcome the problems mentioned above.

The present invention provides a guide nozzle for use with an apparatus for the manufacture of filter rods for smoking articles, comprising a support member configured to be fixed relative to said apparatus for the manufacture of filter rods, a funnel through which loose filter material is propelled, mounted to the support member and, an adjuster mounted between the support member and the funnel to enable the relative position of the funnel and the support member to be adjusted to control the direction of flow of loose filter material propelled through the funnel.

The funnel may be rotatable relative to the support member and may be mounted to the support member in a ball and socket type configuration. The funnel may be frusto-conical in shape and may taper inwards from a wide entrance opening to a narrow exit opening and the support member may comprise an annular member located within the wide entrance opening.

A portion of the funnel at the peripheral edge of the wide entrance opening may be curved inwards and, an outer surface of the annular support member may be correspondingly curved to rotatably sit against the inwardly curved portion of the funnel.

Said inwardly curved portion of the funnel may comprise a plurality of tabs projecting from the peripheral edge of the funnel or said inwardly curved portion of the funnel may comprise a continuous edge of the funnel.

The annular support member may comprise a plurality of radial projections and the outer surfaces of the radial projections may provide said correspondingly curved outer surface to sit against the inwardly curved portion/tabs of the funnel. Alternatively, the annular support member may comprise a continuous outer surface which provides said correspondingly curved outer surface to sit against the inwardly curved portion/tabs of the funnel.

The annular support member may include a central aperture substantially coaxial with the funnel for the flow of filter material through the central aperture and through the funnel.

The inwardly curved portion/tabs of the funnel may include a slot and, said correspondingly curved surface of the annular support member may include a threaded aperture, and the funnel may be moveably secured to the annular support member by a threaded fastener extending through the slot and secured in the threaded aperture.

The adjuster may comprise a shaft with first and second ends having left and right handed threads respectively. The first end may be connected to the funnel and the second end may be connected to the support member. The first end of the shaft may be received in a threaded aperture in a first boss projecting from the funnel and, the second end of the shaft may be received in a threaded aperture in a second boss projecting from the support member.

A first adjuster may be provided on the top of the guide nozzle and a second adjuster may be provided on the side of the guide nozzle.

The funnel may taper inwards from a wide entrance opening to a narrow exit opening and the support member may comprise an annular ring located around the outside of the wide entrance opening.

A portion of the funnel at the peripheral edge of the wide entrance opening may be curved inwards and, an inner surface of the support member may be correspondingly curved to rotatably sit against the outside surface of the inwardly curved portion of the funnel.

The present invention also provides an apparatus for manufacturing a filter rod for a smoking article, comprising a tapering duct having a first open end for introduction of filter material and a second open end for the expulsion of a formed filter rod, the tapering duct narrowing from the first end to the second end so that as filter material is conveyed through the tapering duct it is compressed to form a filter rod, a guide nozzle as described above located adjacent the first open end of the tapering duct to guide loose filter material into the first open end of tapering duct, and a pneumatic/air jet adjacent the guide nozzle on the opposite side thereof to the tapering duct to propel loose filter material through the funnel into the tapering duct.

The apparatus may further comprise a plurality of feeder tubes extending into the tapering duct between the first and second open ends thereof, each feeder tube for introducing a respective one of a plurality of threads into the filter material as the filter material passes through the tapering duct, and the funnel may be positionable relative to the tapering duct to control the direction of flow of loose filter material relative to the ends of the feeder tubes within the tapering duct in order to control the position of the threads in the produced filter rod.

The feeder tubes may extend through a lateral side wall of the tapering duct between the first and second open ends.

The present invention also provides a method of manufacturing a filter rod for a smoking article, the method comprising feeding loose filter material into a funnel of a guide nozzle, propelling the loose filter material through the funnel with an air jet into an open end of a tapering duct of a filter rod forming apparatus, including adjusting the position of the funnel of the guide nozzle relative to the tapering duct to control the direction of flow of filter material into the open end of the tapering duct.

The funnel may be mounted to a support member which is fixed relative to the filter rod forming apparatus, and adjustment of the funnel may comprise rotating the funnel relative to the support member.

The filter rod forming apparatus may include a plurality of feeder tubes extending into the tapering duct, each feeder tube for introducing a respective one of a plurality of threads into the filter material as the filter material passes through the tapering duct, and the funnel may be positioned relative to the ends of the feeder tubes within the tapering duct in order to control the position of the threads in the produced filter rod.

The method may further comprise conveying the filter material with the entrained threads therein through the tapering duct from a first open end towards a second open end thereof as the duct narrows from the first open end to the second open end, compressing the filter material as it passes towards the second open end of the tapering duct, and ejecting the filter rod having the plurality of threads formed therein, from the second open end of the tapering duct.

The filter rod of the invention and produced by the apparatuses and methods of the invention is particularly, but not exclusively, a filter for use in a smoking article such as a cigarette.

In order to fully understand the present invention, embodiments will now be described, by way of example only, with reference to FIGS. 3 to 12 of the accompanying drawings, in which.

Figure 1:
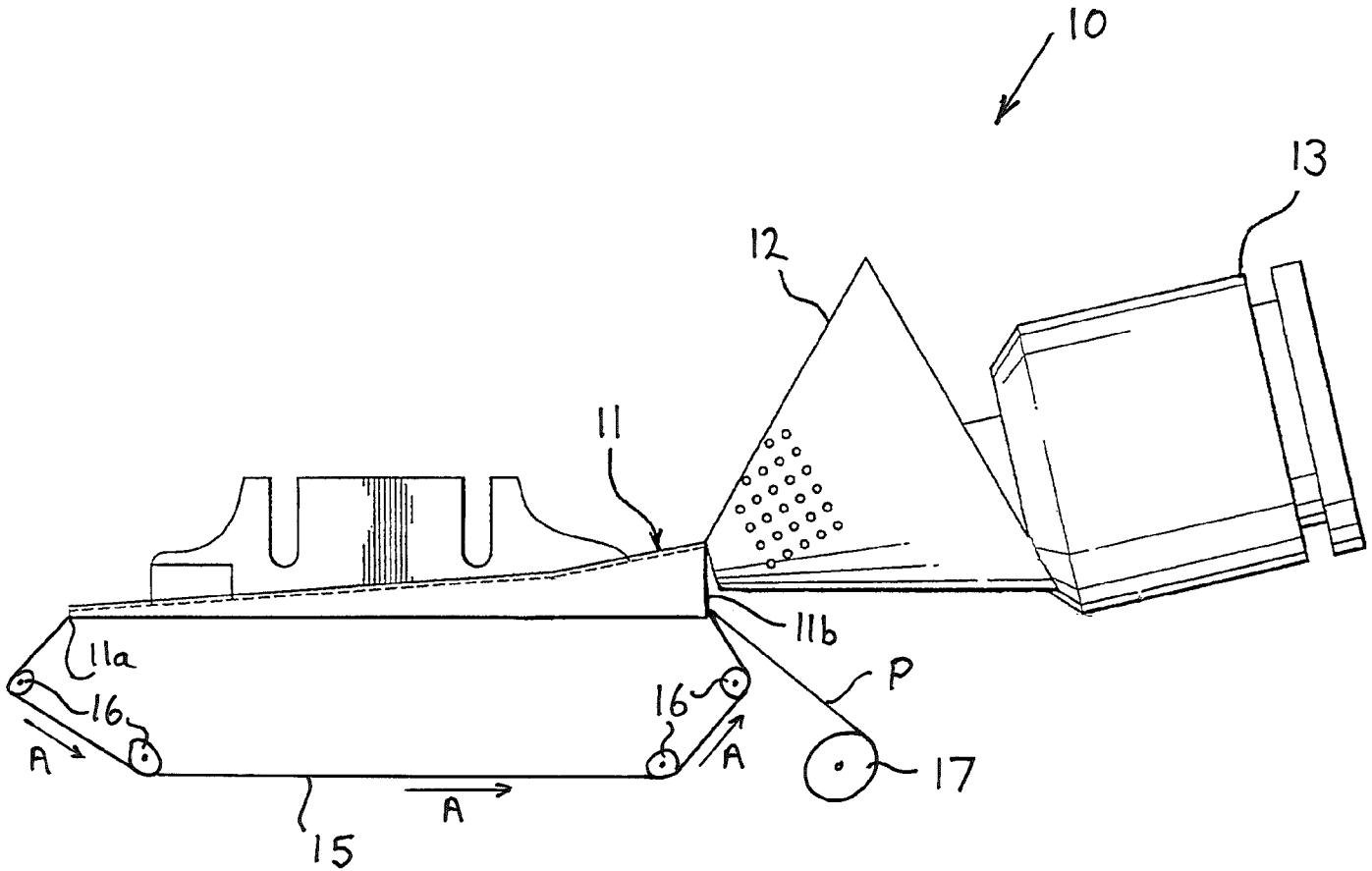
FIG. 1 is a side view showing a first known apparatus for producing a filter rod for a smoking article.

FIG. 1 shows a known apparatus 10 for producing a filter rod for a smoking article, and comprises a tongue 11, a guide nozzle 12 including a funnel portion, and an air jet or 'stuffer jet' 13. The tongue 11 is a tapered duct having a wide entrance opening 11*b* and a narrow exit opening 11*a*. The tongue 11 is generally circular in cross-section and is open at its underside in the form of an elongate slot (not shown) extending along its length in an axial direction thereof such that, in cross-section, the tongue 11 does not quite form a complete circle. The tongue 11 is located on a filter rod forming guide (not shown) which comprises a shaped track along which a continuous belt or 'garniture' 15 runs. The garniture 15 extends over a plurality of guide rollers 16 and is driven to be conveyed around the rollers 16 in the direction shown by arrows 'A'. A filter wrapping paper 'P' is fed from a spool 17 onto the upper surface of the garniture 15 and is conveyed through the tongue 11 by the moving garniture 15. As the wrapping paper P travels though the tongue 11, the shaped track is configured to deform the garniture and wrapping paper P thereon such that, in cross-section, the wrapping paper P goes from being flat (as it is in the spool 17) when it enters the wide entrance opening 11*b* of the tongue 11, to a closed circle as it leaves the narrow exit opening 11*a* of the tongue 11, completely surrounding the formed filter rod.

In use, loose filter tow material (not shown), such as cellulose acetate fibre, is fed into the funnel of the guide nozzle 12 and is guided into the tongue 11. The filter tow material is fed through the continually tapering tongue 11 to form the loose filter tow material into a more compact rod as it emerges from the distal narrow end 11*a*. The stuffer jet 13 provides a continuous blast of compressed air which gathers the loose filter tow material into a lightly compressed state in the funnel of the guide nozzle 12 and propels the lightly compressed filter tow material through the guide nozzle 12 and into the tongue 11. The force of the stuffer jet 13 can be controlled to determine the final density of the filter rod by determining how compressed the filter tow material is prior to being fed into the tongue 11, thereby controlling characteristics such as draw resistance.

As the filter tow material is fed into the tongue 11, it is gathered onto with the wrapping paper P being conveyed on the garniture 15 and is conveyed therewith through the tongue 11. As the filter tow material travels through the tongue 11, it is compressed as the tongue 11 inwardly tapers and the wrapping paper P is folded around the outside of the compressed cylinder of filter tow material, such that when the filter tow material exits though the narrow exit opening 11*a* of the tongue 11, it is formed into a compressed cylindrical filter rod circumscribed by an outer wrapping paper P.

Figure 2:
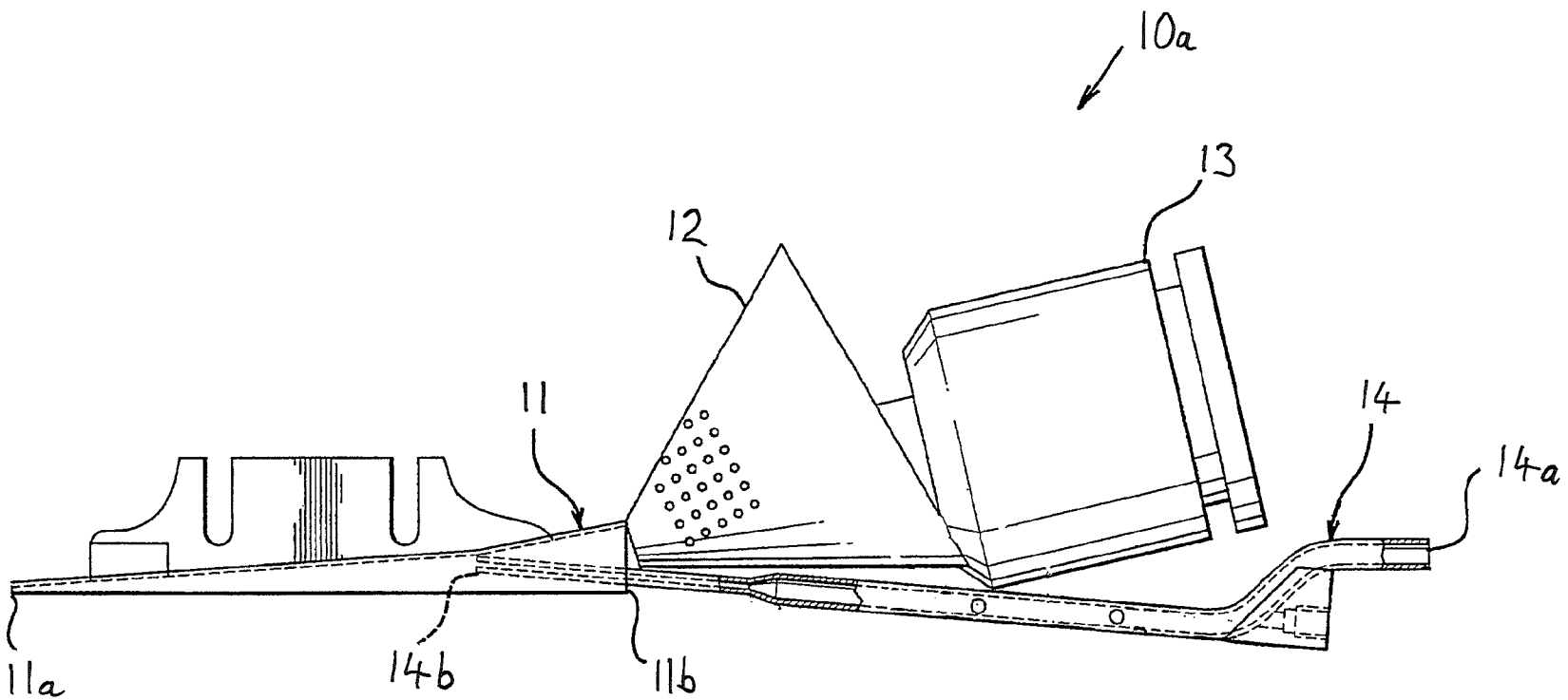
FIG. 2 is a side view showing a second known apparatus for producing a filter rod for a smoking article.

Another known apparatus 10*a* is shown in FIG. 2, and includes all of the same features as the embodiment shown in FIG. 1, such like features retaining the same reference numerals (the garniture 15, rollers 16 and paper spool 17 are present, but are not shown in FIG. 2). In addition to the above-described features, the known apparatus of FIG. 2 further comprises a thread positioning device 14 comprising a hollow tube having an inlet end 14*a* remote from the tongue 11 and an outlet end 14*b* which extends into the wide entrance opening 11*b* of the tongue 11 and which terminates partially through the tongue 11 between the open ends 11*a*, 11*b* thereof. In use, a thread, such as cotton yarn, is fed through the positioning device 14 from the inlet end 14*a* to the outlet end 14*b* as the filter tow material is conveyed though the tongue 11. The thread is entrained in the flow of filter tow material as it travels though the tongue 11 and the resulting filter rod emerging from the exit opening 11*a* of the tongue 11 thereby has the thread extending through the filter rod in a generally axial direction thereof.

It will be appreciated from FIGS. 1 and 2 that the path of the filter tow material being fed into the guide funnel 12 and subsequently into the tongue 11 is fixed and therefore cannot be adjusted or controlled. Therefore, in the known apparatus of FIG. 2, it may be that the bulk of the filter tow material is propelled beneath the thread being fed into the tongue 11, and so the thread may be off-centre in the resulting filter rod. Furthermore, the absence of any means to change the path which the filter tow material takes from the stuffer jet, through the guide funnel/nozzle 12 and into the tongue, means that it is impossible to correct the above problem.

Figure 3:
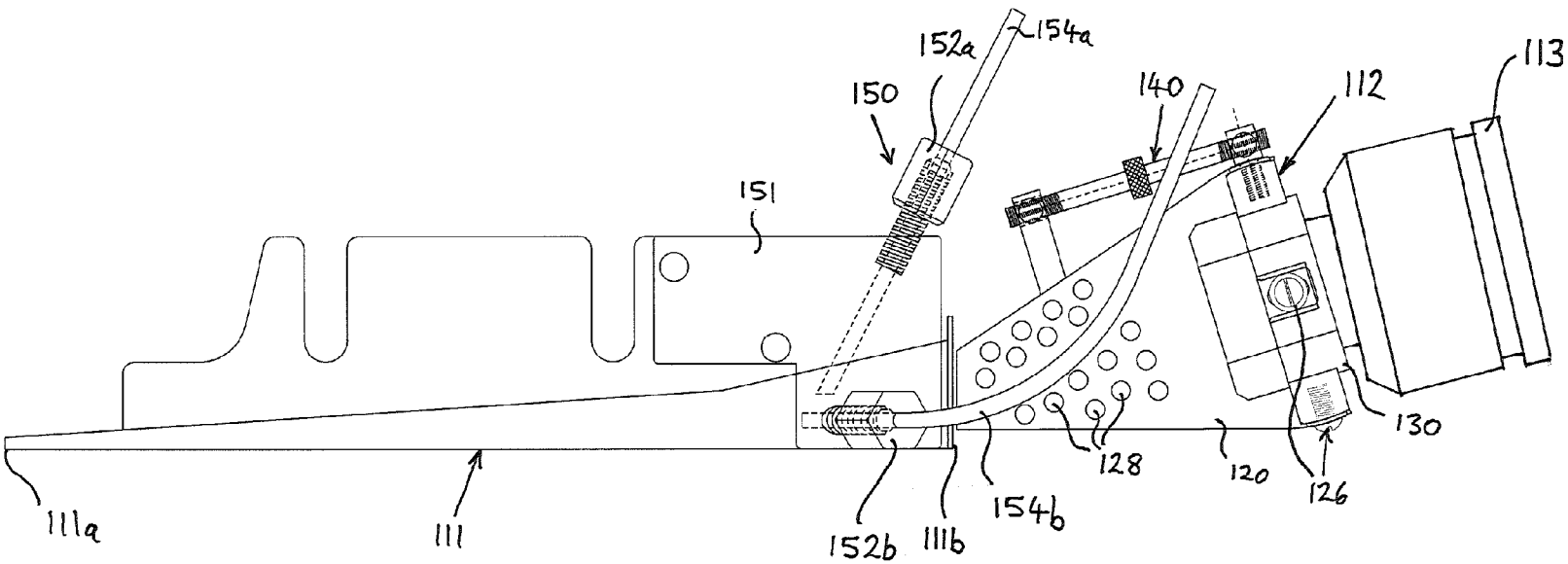
FIG. 3 is a side view showing an apparatus for producing a filter rod for a smoking article, comprising a controllable guide nozzle according to an embodiment of the present invention.
Figure 4:
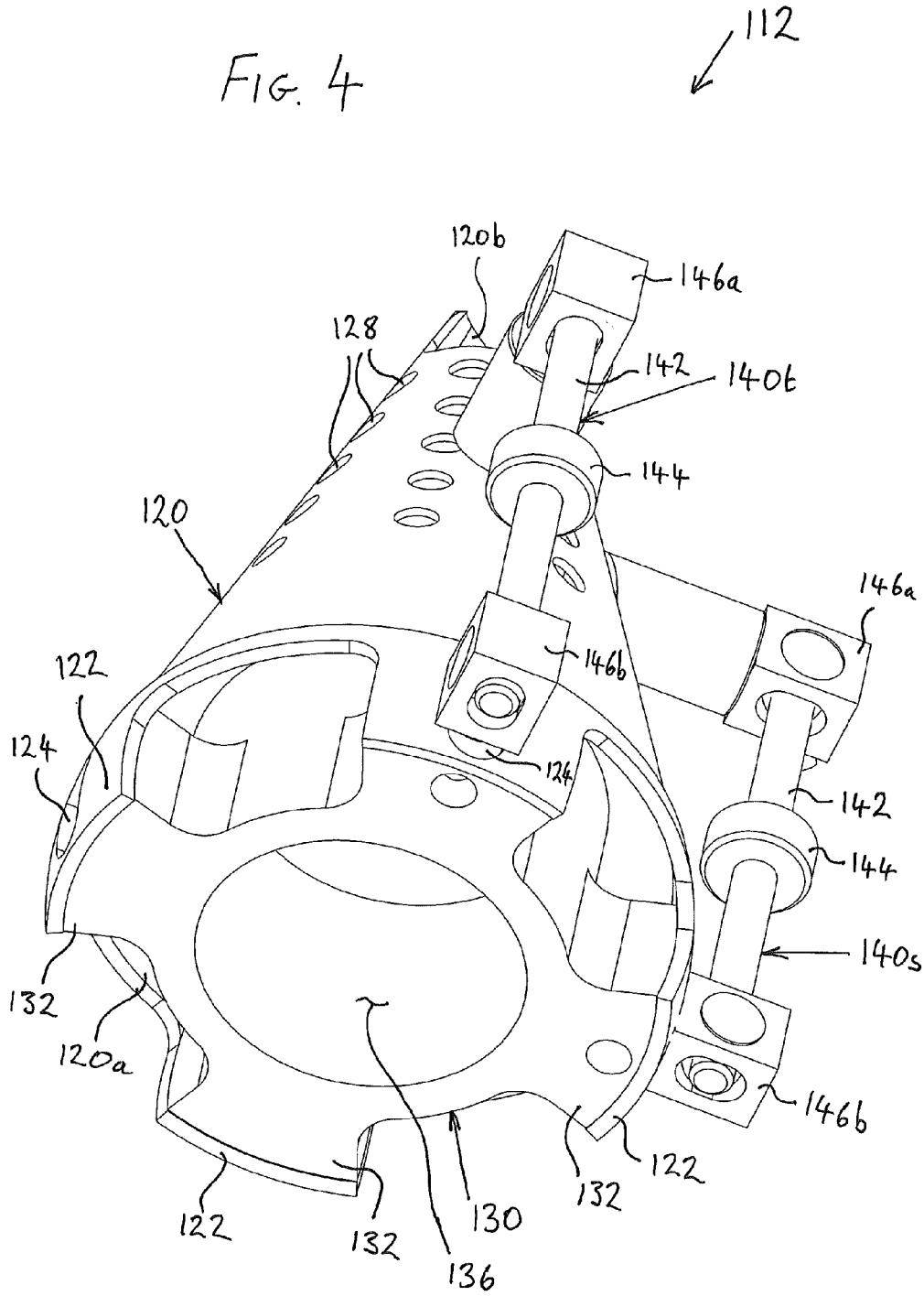
FIG. 4 is a perspective view of the controllable guide nozzle of FIG. 3.
Figure 5:
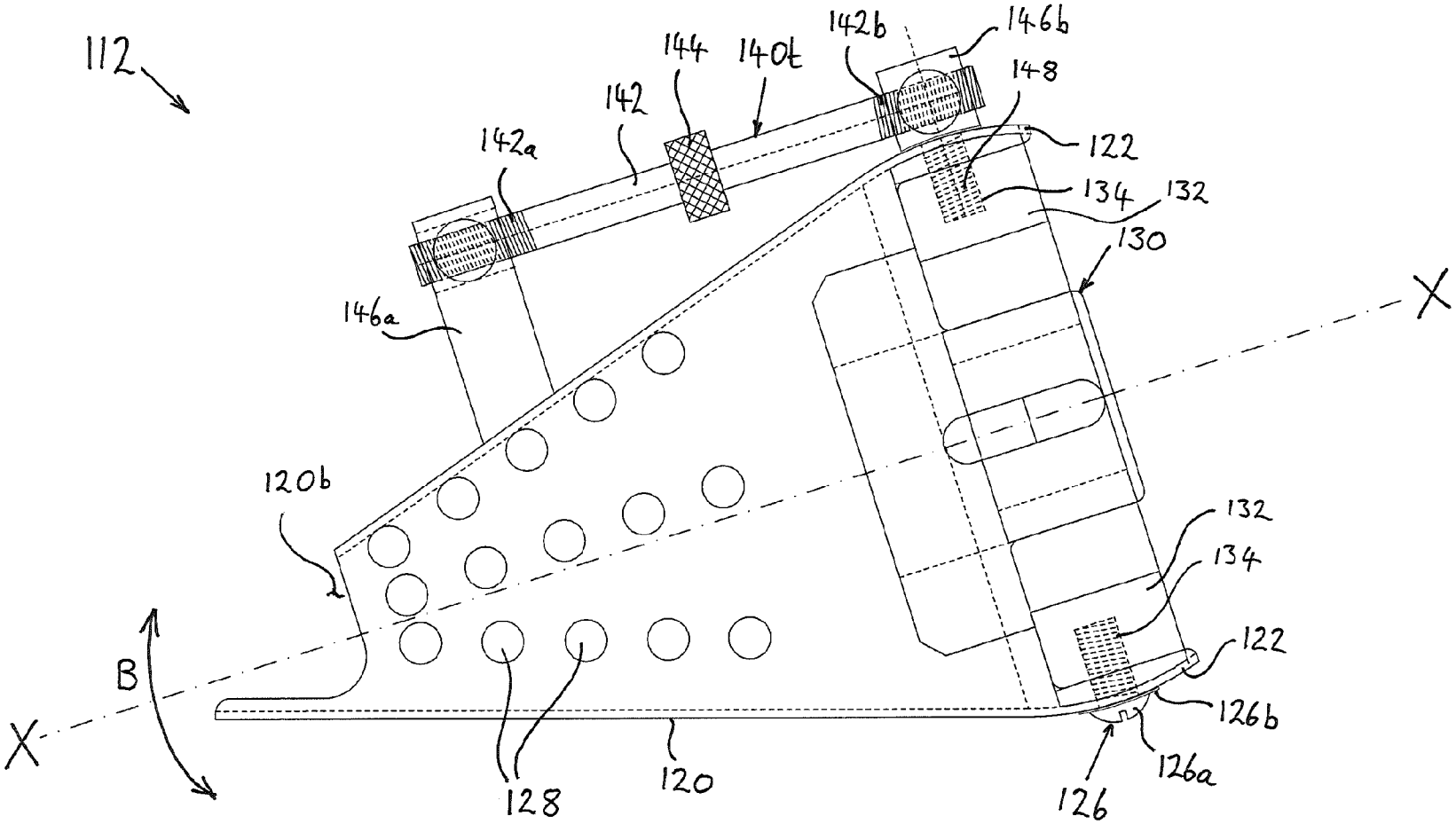
FIG. 5 is a side view of the controllable guide nozzle of FIGS. 3 and 4.
Figure 6:
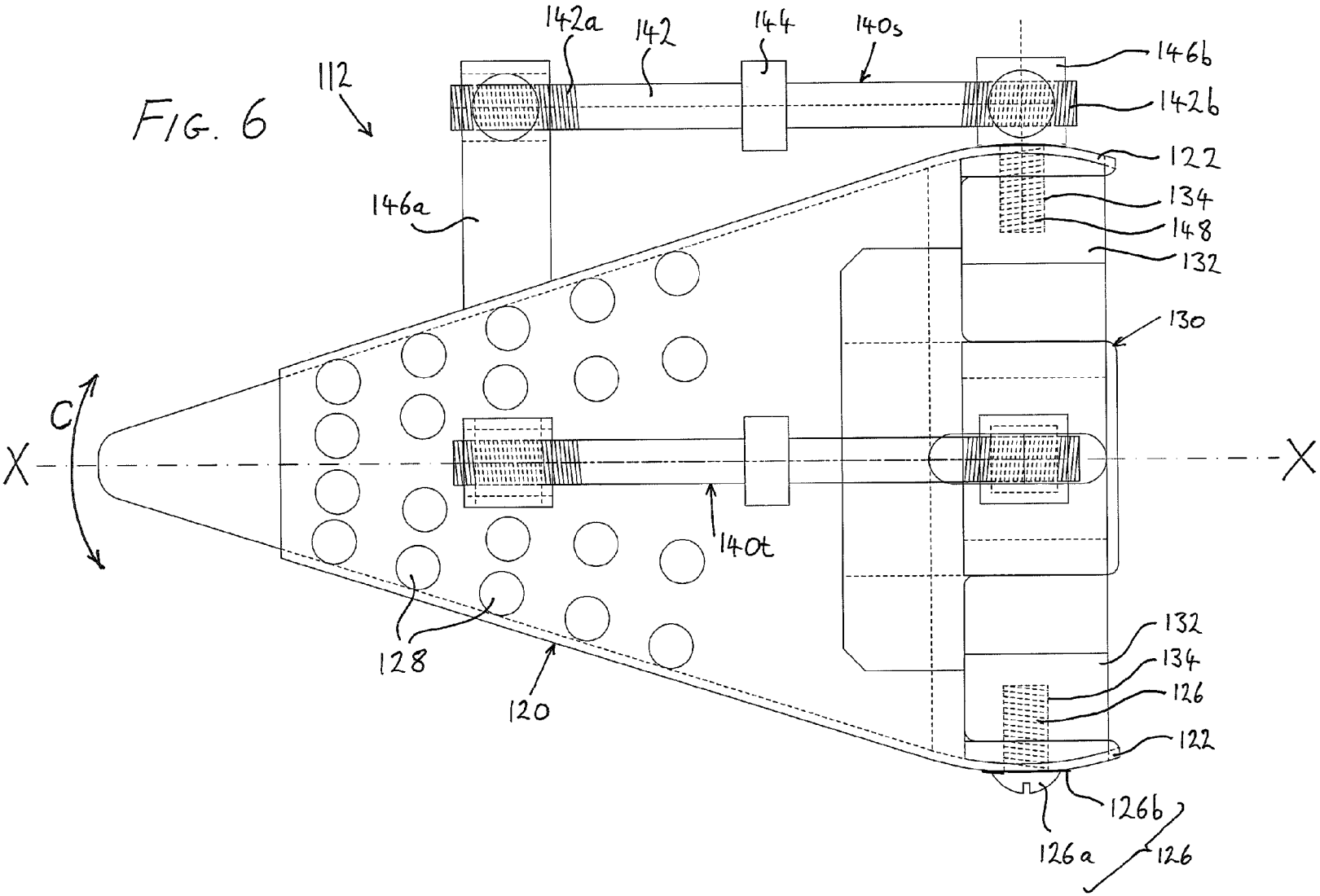
FIG. 6 is a plan view from above of the controllable guide nozzle of FIGS. 3 to 5.
Figure 7:
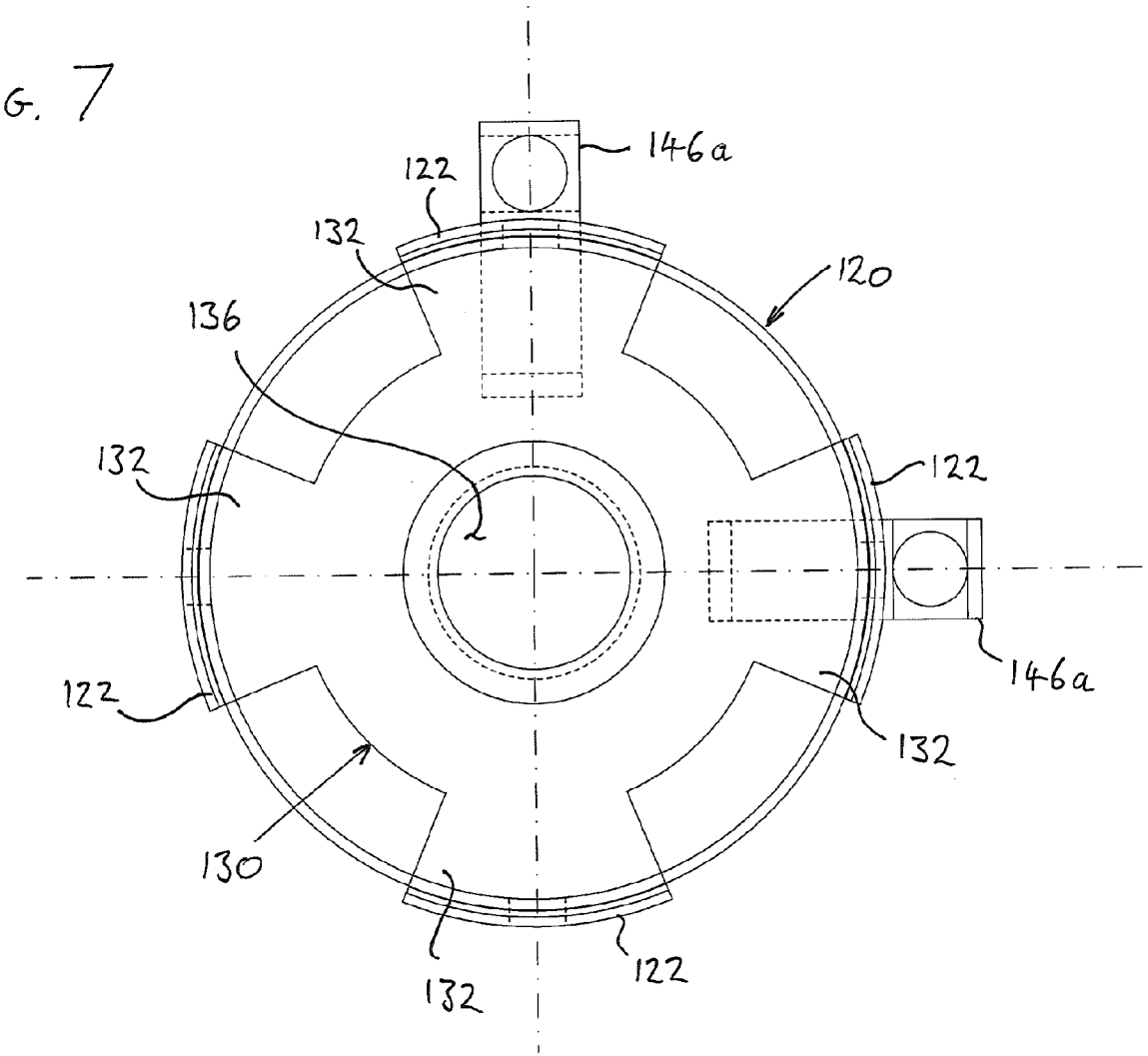
FIG. 7 is a rear view of the controllable guide nozzle of FIGS. 3 to 6 with the retaining means and ventilation holes omitted.
Figure 8:
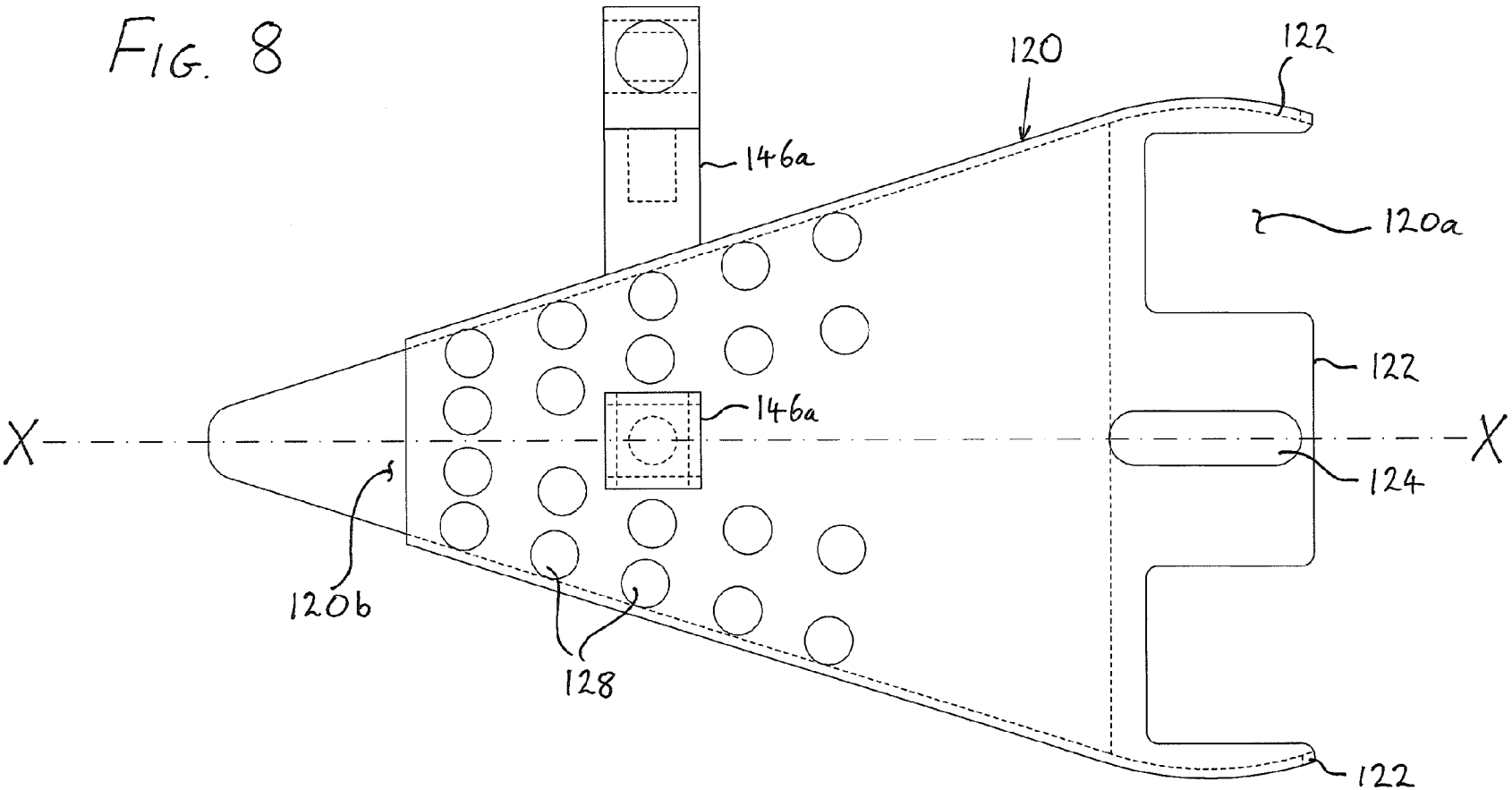
FIG. 8 is a plan view from above of the funnel cone of the controllable guide nozzle of FIGS. 3 to 7.
Figure 9:
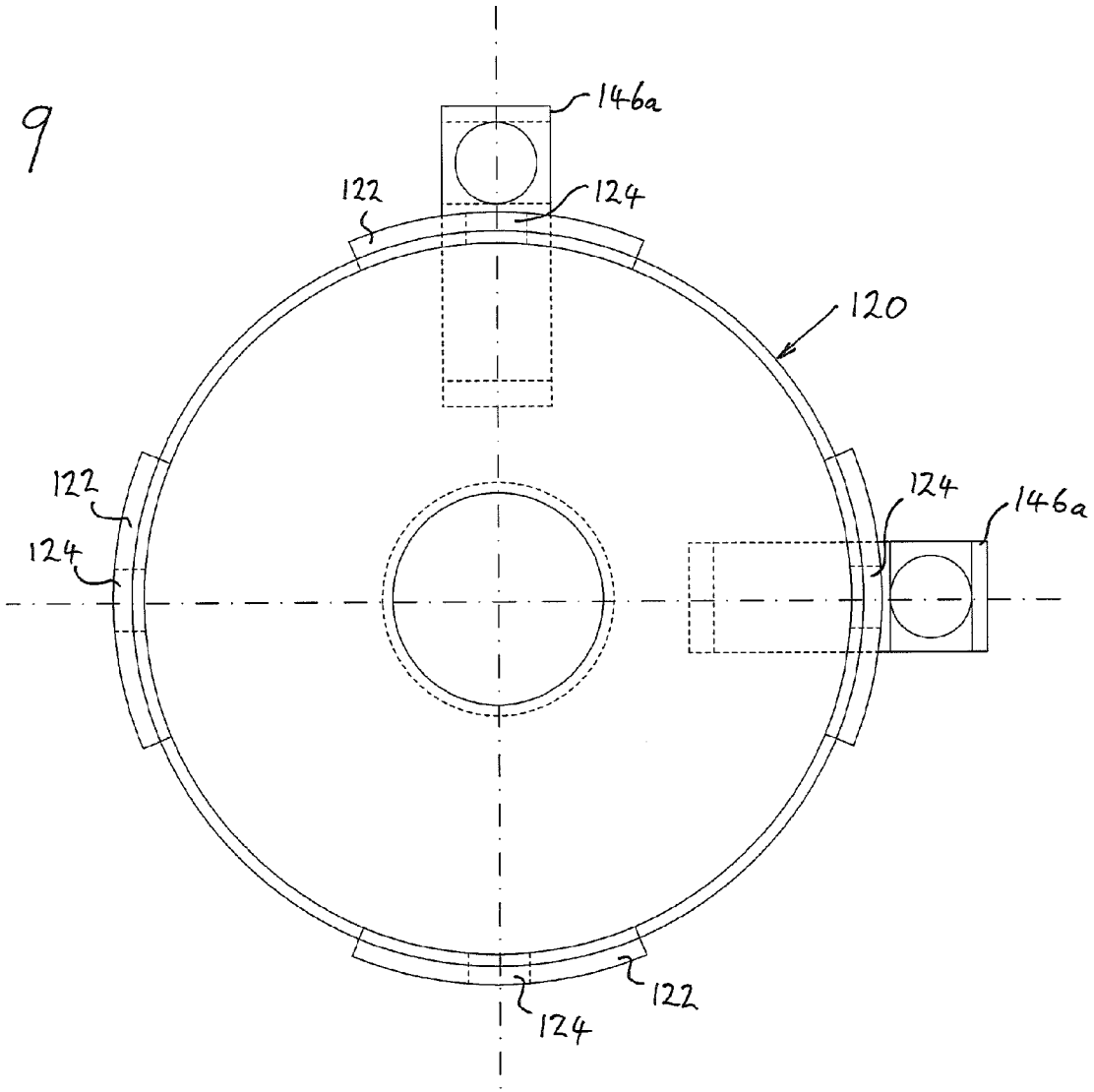
FIG. 9 is a rear view of the funnel cone of the controllable guide nozzle of FIGS. 3 to 8, with the ventilation holes omitted.
Figure 10:
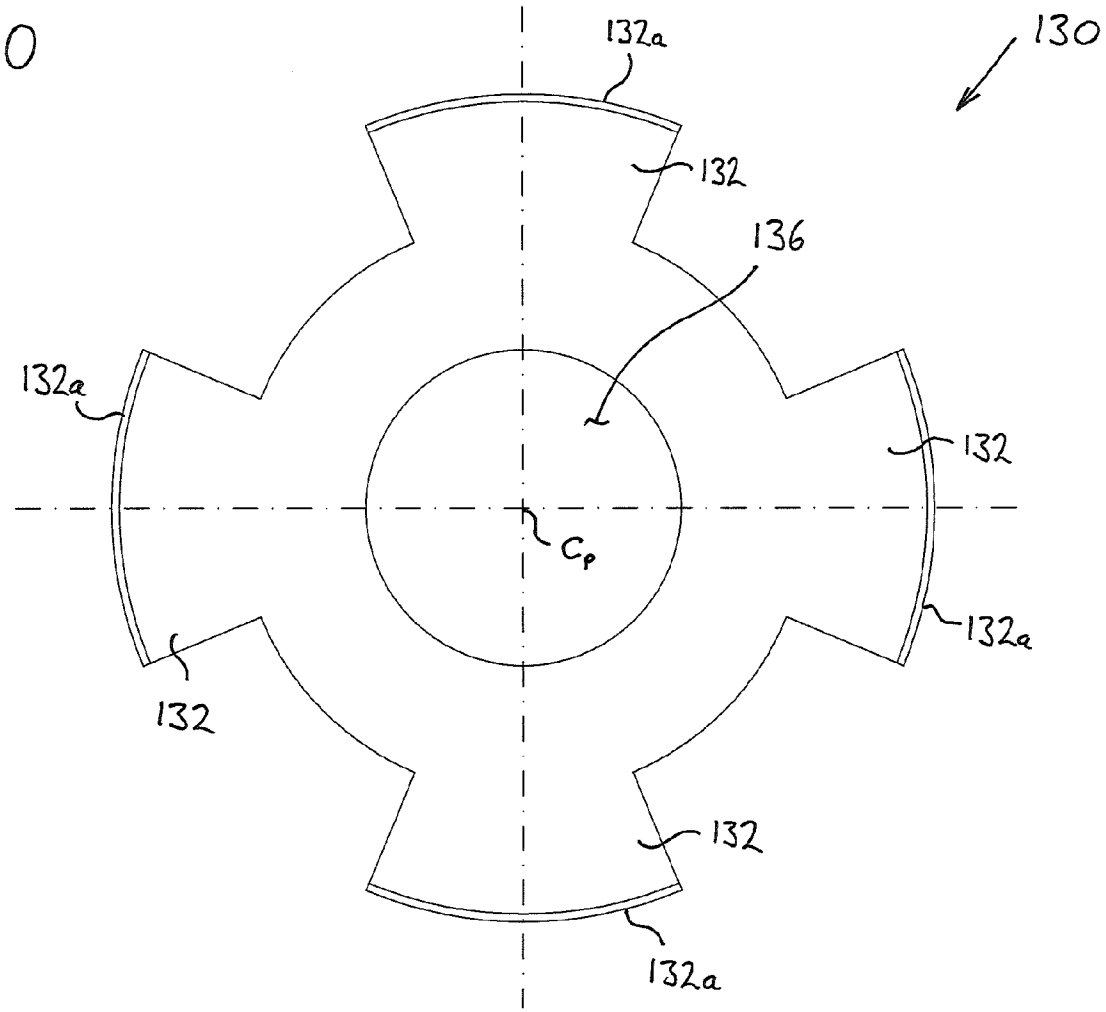
FIG. 10 is a rear view of the annular support member of the controllable guide nozzle of FIGS. 3 to 9.

FIG. 3 shows an apparatus 110 for producing filter rods which includes a guide nozzle 112 of a first embodiment of the present invention. The apparatus includes a tongue 111, having a wide entrance opening 111*b* and a narrow exit opening 111*a*, and a stuffer jet 113, as generally known in the art and as described above with reference to FIGS. 1 and 2 (the garniture, filter wrapping paper P and wrapping paper spool are as in the prior art shown in FIG. 1, but are not shown in FIG. 3).

The apparatus 110 of FIG. 3 includes a multi-thread positioning means, as currently being developed by the applicant and generally indicated as 150, by means of which a plurality of threads can be introduced into the filter tow material as it is conveyed through the tongue 111, through a plurality of a hollow tubes 154*a-c*, known as and referred to hereafter as a 'needles' (a third needle 154*c* is located on the opposite side of the apparatus 110 to the needle indicated at 154*a*, but is not visible in FIG. 3). The needles 154*a-c* are secured to the tongue by adjustable support means 152*a-c* which are retained in a support base 151. Each needle 154*a-c* extends though the respective support means 152*a-c*, through the support base 151 and through a lateral side wall of the tongue 111 and terminates within the bore of the tongue 111. In use, threads are fed through the needles 154*a-c* into the tongue 111 and are entrained in the flow of filter tow material. Thereby, the resulting filter rod has a plurality of threads extending in an axial direction thereof. The needles 154*a-c* are slidable within the respective support means 152*a-c* so that the position at which the ends of the needles 154*a-c* terminate within the bore of the tongue 111 can be adjusted. This allows the position of each thread within the bore of the tongue 111 to be individually adjusted relative to each other thread, and thereby, the relative position of the threads in the resulting filter rod can be controlled.

The applicant has found that the above-described multi-thread positioning means 150 is particularly effective for accurately positioning multiple threads within a filter rod in a desired pattern relative to each other thread. However, in order to locate the set thread pattern in the centre of, or indeed simply any desired position within, the cross-section of the resulting filter rod, it has been advantageous to provide the controllable guide nozzle 112 of the invention, shown in FIG. 3 and in FIGS. 4 to 10. This is because prior art guide nozzles 12, as shown in FIGS. 1 and 2, are fixed relative to the tongue 11 and so the stream of filter tow material through the funnel of the guide nozzle 12 into the tongue 11 is fixed in a single direction. Hence, although the position of each thread relative to the other threads may be accurately determined, if the flow of filter tow material is not exactly in the correct direction, the desired thread pattern within the resulting filter rod may be off-centre.

Referring now to FIGS. 4 to 10, a guide nozzle 112 of the present invention is shown which comprises a funnel portion 120 moveably mounted to a support member 130, and an adjustment means 140 connected between the funnel portion 120 and the support member 130. The funnel portion 120 is generally frusta-conical in shape and tapers inwards from a mouth opening 120*a* to an exit opening 120*b*. The funnel portion 120 includes a plurality of ventilation holes 128 which allow the compressed air from the stuffer jet 113 to escape to allow the correct compaction of the filter material to be achieved and to prevent too much air entering the tongue 111.

The support member 130 is a generally ring-shaped annular member and includes a plurality of projections 132 extending in a radial direction thereof. The radial outer-most surface 132*a* of each projection 132 is curved as a portion of a surface of a sphere having an imaginary centre point $C_P$ coinciding with the centre of the ring of the annular support member 130 (see FIG. 10). The support member 130 includes a central aperture 136. In use, filter tow material flows through this central aperture 136 into the funnel portion 120 of the guide nozzle 112, through the funnel portion 120 and into the wide entrance opening 111*b* of the tongue 111.

The perimeter edge of the mouth opening 120*a* of the funnel portion 120 includes a plurality of curved tabs 122 extending in a generally axial direction X-X of the funnel portion 120. The tabs 122 are curved correspondingly to the outer surface of 132*a* of the projections 132 and are configured so that one tab 122 lies flush against the outer surface 132*a* of each projection 132. Thereby, the funnel 120 is able to rotate about the support member 130 as a 'ball-and-socket' type movement in which the tabs 122 comprise the 'socket' and the projections 132 of the annular support member 130 comprise the 'ball'. The support member 130 is fixed relative to the tongue 111 and the filter rod producing apparatus 110 generally, and so the funnel portion 120 is moveable relative to the support member 130 and thereby relative to the tongue 111 and the rest of the filter rod producing apparatus 110 generally.

Each of the tabs 122 includes a slot 124 extending in generally axial direction of the funnel 120. Each projection 132 includes a threaded aperture 134 extending in a radial direction of the annular support member 130. The funnel 120 is held on the support member 130 by retainers 126 extending through each slot 124 and being screwed into the threaded apertures 134 in the support member 130. Two of the retainers 126 located at the bottom and the left side of the guide nozzle 112 comprise a threaded screw 126*a* and a curved plate or washer 126*b*. Each curved plate 126*b* sits flush against the outer surface of the respective tabs 122 and a screw 126*a* extends through an aperture in the curved plate 126*b*, though the respective slot 124 and is secured in the respective threaded aperture 134 in the projection 132 of the support member 130. Each screw 126*a* is secured such that there is sufficient friction to avoid play between the support member 130 and funnel 120, but so as to still allow the funnel 120 to move relative to the support member 130.

Two further retainers 126 are part of the adjustment means 140 as described hereafter. The adjustment means 140 include a top adjustment means 140*t* and a side adjustment means 140*s* provided on the top and the right side of the guide nozzle 112 respectively. Each adjustment means comprises a shaft 142 having a thread 142*a*, 142*b* formed at each end, and an actuator wheel 144 coaxial with the shaft 142 mid-way along its length. The thread 142*a* of one end of each shaft 142 is threadingly received in a threaded aperture in a first boss 146*a* protruding from the outer surface of the funnel 120. The thread 142*b* at the opposite end of each shaft 142 is threadingly received in a threaded aperture in a second boss 146*b* which is secured to the support member 130. Each second boss 146*b* is secured to the support member 130 by a threaded extension 148 of the second boss 146*b* extending through the slot of 124 of the respective tab 122 and being screwed into the threaded aperture 134 of the respective projection 132 of the support member 130. The second bosses 146*b* are configured such that the sides thereof adjacent the respective tab 122 of the funnel 120 are curved to fit flush thereagainst. Thus, they permit the funnel 120 to move relative to the support member 130 as described above.

The threads 142*a*, 142*b* at opposite ends of each shaft 142 are formed as mirror images of one another such that when each shaft is 142 rotated, depending on the direction of rotation, the first and second bosses 146*a*, 146*b* are caused to either move apart from each other or move towards each other, not move in the same direction as each other.

In use, the guide nozzle 112 of the first embodiment of the invention can be adjusted as follows. In order to alter the direction of flow of filter material exiting the guide nozzle 112 in the vertical plane, a user rotates the actuator wheel 144 of the top adjustment means 140*t*. This causes the threads 142*a*, 142*b* at each end of the shaft 142 to rotate within the threaded apertures in the first and second bosses 146*a*, 146*b* on the top of the guide nozzle 112 respectively. This causes the first boss 146*a* mounted on the top of the funnel 120 to move relative to the second boss 146*b* on the top of the support member 130. Depending on the direction the shaft 142 is rotated in, if this causes the first and second bosses 142*a*, 142*b* on the top of the guide nozzle 112 to move towards each other, it causes the funnel to rotate upwards around the support member 130 and, conversely, if the first and second bosses 142*a*, 142*b* move away from each other, it causes the funnel to rotate downwards around the support member 130. Therefore, since, in use, the support member 130 is fixed relative to a filter rod producing apparatus 110, the funnel 120 is moved upwards or downwards relative to the filter rod producing apparatus 110, thereby altering the direction of the flow of filter tow material in a vertical plane (see arrow B in FIG. 5), thereby altering the direction that the filter tow material flows into the wide open end 111*b* of the tongue 111.

Similarly, in order to alter the direction of flow of filter material through the guide nozzle 112 in the horizontal plane, a user rotates the actuator wheel 144 of the side adjustment means 140*s*. This causes the threads 142*a*, 142*b* at each end of the shaft 142 to rotate within the threaded apertures in the first and second bosses 146*a*, 146*b* on the side of the guide nozzle 112 respectively. This causes the first boss 146*a* mounted on the side of the funnel 120 to move relative to the second boss 146*b* on the side of the support member 130. Depending on the direction the shaft 142 is rotated in, if this causes the first and second bosses 142*a*, 142*b* on the side of the guide nozzle 112 to move towards each other, it causes the funnel to rotate to the right, around the support member 130 and, conversely, if the first and second bosses 142*a*, 142*b* move away from each other, it causes the funnel to rotate to the left, around the support member 130. Therefore, since, in use, the support member 130 is fixed relative to a filter rod producing machine, the funnel 120 is moved left or right relative to the filter rod producing machine, thereby altering the direction of the flow of filter tow material in a horizontal plane (see arrow C in FIG. 6).

It will be appreciated from the above that appropriate adjustment of both the top and side adjustment means 140*t*, 140*s* allows a user to accurately control the direction of flow of filter tow material flowing exiting the guide nozzle 112 out of the exit opening 120*b* of the funnel 120, over an entire 360 degree range of movement, both up and down and left and right.

Use of the guide nozzle 112 of the invention in conjunction with a filter rod producing apparatus 110, as shown in FIG. 3, is as follows. Filter tow material, such as cellulose acetate (not shown), is fed from a supply (not shown) through the guide nozzle 112 and the stuffer jet 113 provides a continuous blast of air to compress the filter tow material and propel it though the funnel 120 of the guide nozzle 112 and into the wide entrance opening 111*b* of the tongue 111 to be collected by the garniture and filter wrapping paper (not shown) and conveyed thereon through the tongue 111. Simultaneously, threads are fed into the distal ends of the needles 154*a-c* remote from the tongue 111, and fed through the needles 154*a-c* where they exit at the opposite distal end of the needles 154*a-c* within the central bore of the tongue 111. The needles 154*a-c* have previously been carefully positioned to produce a desired thread pattern within the filter rod to be produced. As the filter tow material is conveyed through the bore of the tongue 111, the threads are entrained in the flow of the filter tow material and pulled through the needles 154*a-c* as the filter tow material passes through the tongue 111. As a result, the emerging compressed filter rod which exits from the narrow exit opening 111*a* in the tongue 111 has three separate continuous threads formed therein and extending in an axial direction thereof, which are accurately positioned relative to one another within the cross-section of the filter rod.

The exact position of the pattern of threads within the cross-section of the resulting filter rod can be accurately determined and adjusted using the guide nozzle 112 of the invention as follows. If the position of the threads in the cross-section of the filter rod is off centre by being too near the upper edge of the filter rod, the guide nozzle 112 can be adjusted so that the flow of filter tow material directed into the wide entrance opening 111*b* of the tongue 111 is moved upwards, so that more filter tow material is provided above the ends of the needles 154*a-c*, and less beneath the ends of the needles 154*a-c*. The guide nozzle is adjusted as described above using the actuator wheel 144 of the top adjustment means 140*t* to move the funnel portion 120 as required. Similarly, if the position of the threads in the cross-section of the filter rod is off centre by being too near the left edge of the filter rod, the guide funnel 112 can be adjusted so that the flow of filter tow material directed into the wide entrance opening 111*b* of the tongue 111 is moved to the left, so that more filter tow material is provided to the left of the ends of the needles 154*a-c*, and less to the right of the ends of the needles 154*a-c*. The guide nozzle is adjusted as described above using the actuator wheel 144 of the side adjustment means 140*s* to move the funnel portion 120 as required. Obviously, similar but opposite adjustments may be made if the thread pattern is too low or too far to the right within the resulting filter rods, or any combination of necessary adjustments may be made, as described above, so that the set thread pattern is exactly located within the cross-section of the resulting filter rod as required.

Although the filter producing apparatus including the guide nozzle 112 of the invention is shown as having three needles 154*a-c* to introduce three threads into a filter rod, other variants of the filter rod producing apparatus are envisaged within the scope of the invention, not being limited to apparatuses having only this number of needles, as will be described hereafter with reference to FIG. 11.

Figure 11:
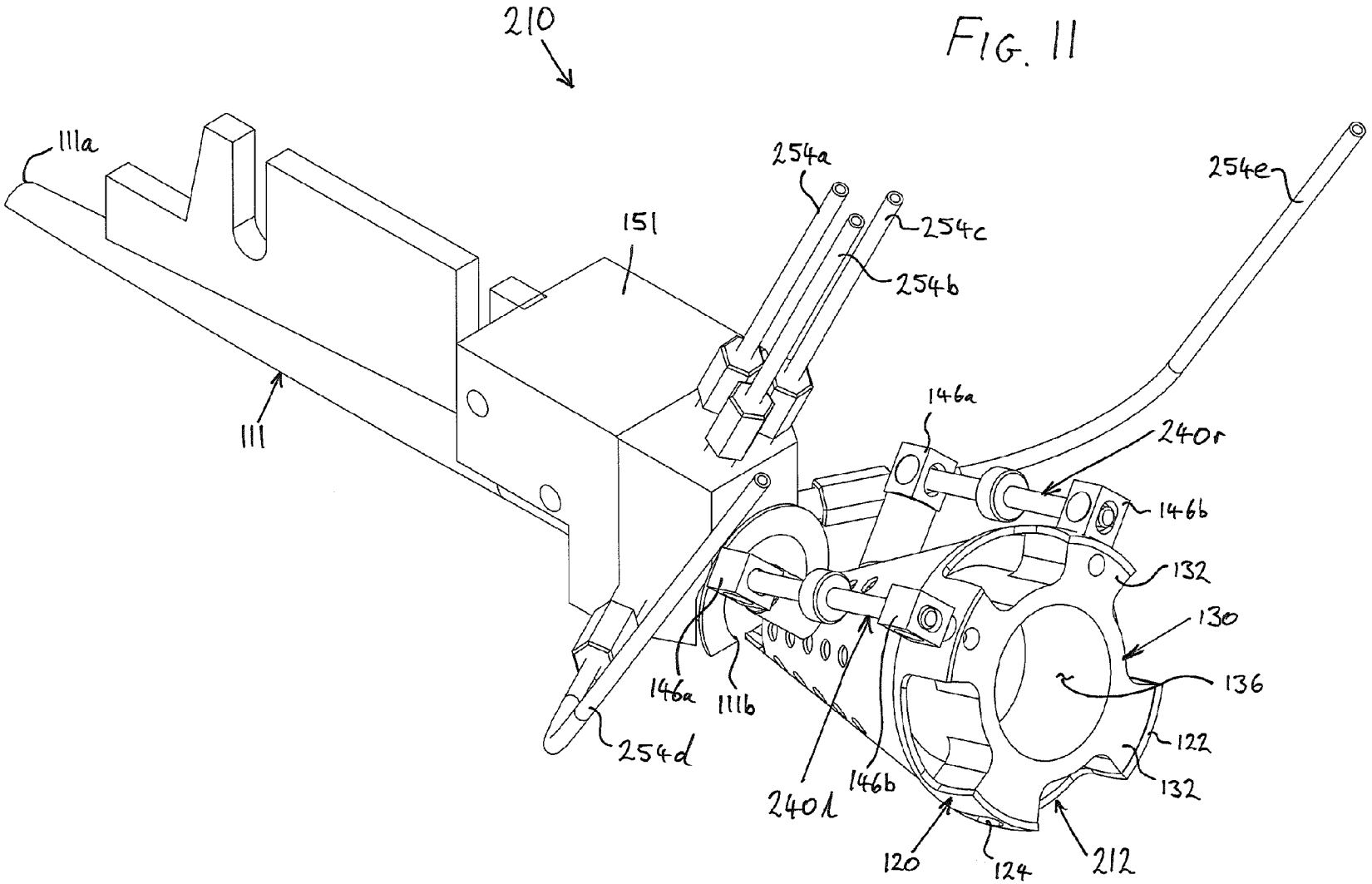
FIG. 11 is a perspective view showing another apparatus for producing a filter rod for a smoking article, comprising a controllable nozzle according to a second embodiment of the present invention.

A guide nozzle 212 of a second embodiment of the invention is shown in FIG. 11 in conjunction with an alternative filter producing apparatus 210. The filter producing apparatus is similar to that shown in FIG. 3, and like features retain the same reference numerals. However, instead of being capable of introducing three threads into a filter rod, the apparatus includes five needles 254*a-e* for introducing up to five separate threads into a filter rod. Otherwise, the filter producing apparatus is the same as that shown in FIG. 3 and described above.

It can be seen that the guide nozzle 212 corresponds largely to that of the first embodiment 112 described above, except that is has adjustment means 240*l* and 240*r* which are located on the guide nozzle 212 differently to that of the first embodiment of the invention. It can be seen that the two adjustment means 240*l*, 240*r* are displaced by 45 degrees with respect to the central axis of the funnel portion 140 of the guide nozzle 212, when compared to the adjustment means 140*t*, 140*s* of the first embodiment of the invention. The adjustment means 240*l*, 240*r* therefore comprise a first adjustment means 240*l* located on the top left of the guide nozzle 212, and a second adjustment means 240*r* located on the top right of the guide nozzle 212. However, despite this different arrangement of adjustment means, it will be appreciated that the funnel portion 120 of the guide nozzle 212 of the second embodiment of the invention may still be adjusted over a whole 360 degree range of rotational movement relative to the support member 130 because the two adjustment means 240*l*, 240*r* are disposed at 90 degrees to one another about the central axis of the funnel portion 120 of the guide nozzle 212. Thus, operation of the guide nozzle of the second embodiment of the invention is very similar to that of the first embodiment of the invention described above, so a detailed description will not be repeated.

Although the guide nozzles 112, 212 of the invention are shown and described as having tabs 122 projecting from the perimeter edge of the funnel portion 120, it will be appreciated that the whole perimeter edge of the funnel portion may be continuous and inwardly curved instead of having discrete projecting tabs, in order to provide the 'socket' portion of the 'ball-and-socket' type mounting configuration of the funnel portion and support member. Furthermore, although the support member is shown as an annular member having radial projections which contact the tabs of the funnel portion, it will be appreciated that the support member may include a continuous curved outer surface instead of having discrete radial projections, in order to provide the 'ball' portion of the 'ball-and-socket' type mounting configuration of the funnel portion and support member. Also, any combination of these variants may be provided, within the scope of the invention.

Although the guide nozzles 112, 212 of the invention are shown and described as having the support member in the form of an annular member located within the wide open end of the funnel portion of the guide nozzle to provide the 'ball-and-socket' type mounting configuration, an alternative configuration is intended to fall with scope of the invention in which the support member includes an annular aperture which located around the outside surface of the inwardly curved tabs/continuous perimeter edge of the funnel portion. In such an embodiment, the inwardly curved tabs/perimeter edge of the funnel portion would comprise the 'ball' of the 'ball-and-socket' type mounting configuration, and the support member with the annular aperture would provide the 'socket' of the 'ball-and-socket' type mounting configuration.

Various modifications to the exemplary embodiments of the invention described above are envisaged within the scope of the invention, which is defined by the claims hereafter. Furthermore, any combination of two or more non-mutually exclusive features of the above-described embodiments is intended to fall within the scope of the invention.

The invention claimed is:

1. A guide nozzle for use with an apparatus for the manufacture of filter rods for smoking articles, comprising:

a support member configured to be fixed relative to an apparatus for the manufacture of filter rods;

a funnel through which loose filter material is propelled, mounted to the support member; and an adjuster mounted between the support member and the funnel to enable the relative position of the funnel and the support member to be adjusted to control the direction of flow of loose filter material propelled through the funnel.

2. The guide nozzle according to claim 1 wherein the funnel is rotatable relative to the support member.

3. The guide nozzle according to claim 1 wherein the funnel is mounted to the support member in a ball and socket type configuration.

4. The guide nozzle according to claim 3 wherein the funnel is frusto-conical in shape.

5. The guide nozzle according to claim 4 wherein the funnel tapers inwards from a wide entrance opening to a narrow exit opening and the support member comprises an annular member located within the wide entrance opening.

6. The guide nozzle according to claim 5 wherein a portion of the funnel at the peripheral edge of the wide entrance opening is curved inwards and, an outer surface of the annular support member is correspondingly curved to rotatably sit against the inwardly curved portion of the funnel.

7. The guide nozzle according to claim 6 wherein said inwardly curved portion of the funnel comprises a plurality of tabs projecting from the peripheral edge of the funnel.

8. The guide nozzle according to claim 6 wherein said inwardly curved portion of the funnel comprises a continuous edge of the funnel.

9. The guide nozzle according to claim 6 wherein the annular support member comprises a plurality of radial projections and the outer surfaces of the radial projections provide said correspondingly curved outer surface to sit against the inwardly curved portion of the funnel.

10. The guide nozzle according to claim 6 wherein the annular support member comprises continuous outer surface which provides said correspondingly curved outer surface to sit against the inwardly curved portion of the funnel.

11. The guide nozzle according to claim 6 wherein the annular support member includes a central aperture substantially coaxial with the funnel for a flow of filter material through the central aperture and through the funnel.

12. The guide nozzle according to claim 6 wherein the inwardly curved portion of the funnel includes a slot and, said correspondingly curved surface of the annular support member includes a threaded aperture, the funnel being moveably secured to the annular support member by a threaded fastener extending through the slot and secured in the threaded aperture.

13. The guide nozzle according to claim 4 wherein the funnel tapers inwards from a wide entrance opening to a narrow exit opening and the support member comprises an annular ring located around the outside of the wide entrance opening.

14. The guide nozzle according to claim 13 wherein a portion of the funnel at the peripheral edge of the wide entrance opening is curved inwards and, an inner surface of the support member is correspondingly curved to rotatably sit against an outside surface of the inwardly curved portion of the funnel.

15. The guide nozzle according to claim 1 wherein the adjuster comprises a shaft with first and second ends having left and right handed threads respectively, the first end connected to the funnel and the second end connected to the support member.

16. The guide nozzle according to claim 15 wherein the first end of the shaft is received in a threaded aperture in a first boss projecting from the funnel and, the second end of the shaft is received in a threaded aperture in a second boss projecting from the support member.

17. The guide nozzle according to claim 16 wherein a first adjuster is provided on the top of the guide nozzle and a second adjuster is provided on the side of the guide nozzle.

18. An apparatus for manufacturing a filter rod for a smoking article, comprising:

a tapering duct having a first open end for introduction of filter material and a second open end for the expulsion of a formed filter rod, the tapering duct narrowing from the first end to the second end so that as filter material is conveyed through the tapering duct it is compressed to form the filter rod;

a guide nozzle, the guide nozzle comprising:

a support member configured to be fixed relative to an apparatus for the manufacture of filter rods;

a funnel through which loose filter material is propelled, mounted to the support member; and an adjuster mounted between the support member and the funnel to enable the relative position of the funnel and the support member to be adjusted to control the direction of flow of loose filter material propelled through the funnel;

the guide nozzle being adjacent the first open end of the tapering duct to guide loose filter material into the first open end of the tapering duct; and a pneumatic jet adjacent the guide nozzle on the opposite side thereof to the tapering duct to propel loose filter material through the funnel into the tapering duct.

19. The apparatus according to claim 18 further comprising a plurality of feeder tubes extending into the tapering duct between the first and second open ends thereof, each feeder tube for introducing a respective one of a plurality of threads into the filter material as the filter material passes through the tapering duct, the funnel being positionable relative to the tapering duct to control the direction of flow of loose filter material relative to the ends of the feeder tubes within the tapering duct in order to control the position of the threads in the produced filter rod.

20. The apparatus according to claim 19 wherein the feeder tubes extend through a lateral side wall of the tapering duct between the first and second open ends.

21. A method of manufacturing a filter rod for a smoking article, the method comprising feeding lose filter material into a funnel of a guide nozzle, propelling the loose filter material through the funnel with an air jet into an open end of a tapering duct of a filter rod forming apparatus, including adjusting the position of the funnel of the guide nozzle relative to the tapering duct to control the direction of flow of filter material into the open end of the tapering duct.

22. The method according to claim 21 wherein the funnel is mounted to a support member which is fixed relative to the filter rod forming apparatus, and wherein adjustment of the funnel comprises rotating the funnel relative to the support member.

23. The method according to claim 22 wherein the filter rod forming apparatus includes a plurality of feeder tubes extending into the tapering duct, each feeder tube for introducing a respective one of a plurality of threads into the filter material as the filter material passes through the tapering duct, and wherein the funnel is positioned relative to the ends of the feeder tubes within the tapering duct in order to control the position of the threads in the produced filter rod.

24. The method according to claim 23 comprising conveying the filter material with entrained threads therein through the tapering duct from a first open end towards a second open end thereof as the duct narrows from the first open end to the second open end, compressing the filter material as it passes towards the second open end of the tapering duct, and ejecting the filter rod having the plurality of threads formed therein, from the second open end of the tapering duct.

* * * * *

UNITED STATES PATENT AND TRADEMARK OFFICE

CERTIFICATE OF CORRECTION

PATENT NO. : 8,652,020 B2
APPLICATION NO. : 13/259695
DATED : February 18, 2014
INVENTOR(S) : Andy Davis et al.

It is certified that error appears in the above-identified patent and that said Letters Patent is hereby corrected as shown below:

On the title page (1):

Item (73) Assignee:

"British Amercian Tobacco (Investments) Limited" should be changed to
-- British American Tobacco (Investments) Limited --

Signed and Sealed this
Seventeenth Day of June, 2014

Michelle K. Lee

Michelle K. Lee
*Deputy Director of the United States Patent and Trademark Office*